US008489406B2

(12) United States Patent
Wu et al.

(10) Patent No.: US 8,489,406 B2
(45) Date of Patent: Jul. 16, 2013

(54) STEREO ENCODING METHOD AND APPARATUS

(75) Inventors: Wenhai Wu, Beijing (CN); Yue Lang, Munich (DE); Lei Miao, Beijing (CN); Zexin Liu, Beijing (CN); Chen Hu, Shenzhen (CN); Qing Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/208,460

(22) Filed: Aug. 12, 2011

(65) Prior Publication Data

US 2011/0301962 A1 Dec. 8, 2011

Related U.S. Application Data

(63) Continuation of application No. PCT/CN2009/070428, filed on Feb. 13, 2009.

(51) Int. Cl.
*G10L 19/00* (2006.01)

(52) U.S. Cl.
USPC ..... 704/502; 704/200.1; 704/210

(58) Field of Classification Search
USPC ..... 704/501–504
See application file for complete search history.

(56) References Cited

U.S. PATENT DOCUMENTS 5,434,948 A * 7/1995 Holt et al. ..... 704/220
6,865,215 B1 * 3/2005 Russell et al. ..... 375/133
6,973,184 B1 * 12/2005 Shaffer et al. ..... 379/420.01
6,973,431 B2 * 12/2005 Cooper et al. ..... 704/503
7,299,190 B2 * 11/2007 Thumpudi et al. ..... 704/500
7,502,743 B2 * 3/2009 Thumpudi et al. ..... 704/500
7,778,824 B2 * 8/2010 Mo et al. ..... 704/207
7,848,932 B2 * 12/2010 Goto et al. ..... 704/500
7,917,357 B2 * 3/2011 Florencio et al. ..... 704/215
7,979,282 B2 * 7/2011 Kim et al. ..... 704/500

(Continued)

FOREIGN PATENT DOCUMENTS

CN 101091206 A 12/2007
CN 101253557 A 8/2008

(Continued)

OTHER PUBLICATIONS

Ericsson, et al., "Updated High Level Description (CuTA)", Confidential according to Q23_SWB9p collaboration agreement: https://132.210.72.248/users/Q23_swb9p/ALL/SignedCollaborationAgreement, pp. 1-17, (Nov. 5, 2008).

(Continued)

*Primary Examiner* — Jialong He
*Assistant Examiner* — Jie Shan
(74) *Attorney, Agent, or Firm* — Conley Rose, P.C.; Grant Rodolph; Nicholas K. Beaulieu

(57) ABSTRACT

A stereo encoding method and apparatus are provided, so as to reduce distortion caused by delay adjustment. The stereo encoding method includes: extracting a current interchannel delay of a stereo signal and a previous delay adjacent to the current interchannel delay; performing adjustment frame judgment according to characteristics of the current stereo signal when the current delay and the previous delay are different; and performing delay adjustment on the stereo signal by using the current interchannel delay if it is judged that a frame where the current delay occurs is an adjustment frame.

14 Claims, 4 Drawing Sheets

U.S. PATENT DOCUMENTS

| | | | | |
|---|---|---|---|---|
| 8,015,000 | B2 * | 9/2011 | Zopf et al. | 704/208 |
| 8,032,362 | B2 * | 10/2011 | Choo et al. | 704/219 |
| 8,036,390 | B2 * | 10/2011 | Goto et al. | 381/17 |
| 8,160,258 | B2 * | 4/2012 | Jung et al. | 381/2 |
| 8,218,775 | B2 * | 7/2012 | Norvell et al. | 381/23 |
| 8,234,122 | B2 * | 7/2012 | Kim et al. | 704/500 |
| 8,255,234 | B2 * | 8/2012 | Thumpudi et al. | 704/503 |
| 2002/0184012 | A1 * | 12/2002 | Burnett et al. | 704/223 |
| 2003/0043856 | A1 * | 3/2003 | Lakaniemi et al. | 370/503 |
| 2004/0019492 | A1 * | 1/2004 | Tucker et al. | 704/500 |
| 2004/0102970 | A1 * | 5/2004 | Oshikiri et al. | 704/233 |
| 2005/0105816 | A1 * | 5/2005 | Ohmi et al. | 382/253 |
| 2006/0190247 | A1 * | 8/2006 | Lindblom | 704/230 |
| 2007/0276657 | A1 * | 11/2007 | Gournay et al. | 704/203 |
| 2008/0008323 | A1 * | 1/2008 | Hilpert et al. | 381/1 |
| 2008/0091419 | A1 * | 4/2008 | Yoshida et al. | 704/219 |
| 2008/0211805 | A1 * | 9/2008 | Blythe et al. | 345/419 |
| 2009/0063139 | A1 * | 3/2009 | Tammi et al. | 704/207 |
| 2009/0070106 | A1 * | 3/2009 | Gao et al. | 704/225 |
| 2009/0080666 | A1 * | 3/2009 | Uhle et al. | 381/17 |
| 2009/0119111 | A1 * | 5/2009 | Goto et al. | 704/500 |
| 2009/0150161 | A1 * | 6/2009 | Faller | 704/500 |
| 2009/0150162 | A1 * | 6/2009 | Goto et al. | 704/500 |
| 2009/0262945 | A1 * | 10/2009 | Teo et al. | 381/2 |
| 2010/0241256 | A1 * | 9/2010 | Goldstein et al. | 700/94 |
| 2010/0290629 | A1 * | 11/2010 | Morii | 381/2 |
| 2010/0322429 | A1 * | 12/2010 | Norvell et al. | 381/22 |
| 2011/0022402 | A1 * | 1/2011 | Engdegard et al. | 704/501 |
| 2011/0224994 | A1 * | 9/2011 | Norvell et al. | 704/500 |
| 2011/0261257 | A1 * | 10/2011 | Terry et al. | 348/515 |
| 2011/0288872 | A1 * | 11/2011 | Liu et al. | 704/500 |
| 2011/0301962 | A1 * | 12/2011 | Wu et al. | 704/502 |
| 2011/0311058 | A1 * | 12/2011 | Oh et al. | 381/2 |
| 2012/0016503 | A1 * | 1/2012 | Lang et al. | 700/94 |
| 2012/0016632 | A1 * | 1/2012 | Wu et al. | 702/176 |
| 2012/0053714 | A1 * | 3/2012 | Wu et al. | 700/94 |
| 2012/0095769 | A1 * | 4/2012 | Zhang et al. | 704/500 |
| 2012/0134511 | A1 * | 5/2012 | Vilermo et al. | 381/107 |
| 2012/0136669 | A1 * | 5/2012 | Hu et al. | 704/500 |
| 2012/0189127 | A1 * | 7/2012 | Wu et al. | 381/22 |

FOREIGN PATENT DOCUMENTS

| | | | |
|---|---|---|---|
| EP | 1 814 104 | A1 | 11/2005 |
| EP | 1814104 | A1 * | 8/2007 |
| EP | 1 953 736 | A1 | 8/2008 |
| EP | 1953736 | A1 * | 8/2008 |
| WO | WO 2006/060278 | A1 | 6/2006 |
| WO | WO 2010108445 | A1 * | 9/2010 |

OTHER PUBLICATIONS

International Search Report from the Chinese Patent Office in International Application No. PCT/CN2009/070428 mailed Nov. 19, 2009.

Written Opinion of the International Searching Authority from the Chinese Patent Office in International Application No. PCT/CN2009/070428 dated Nov. 12, 2009.

Extended European Search Report dated Jun. 11, 2012, pursuant to Rule 62 EPC, issued in related Application No. 09839878.7-2225.

Chinese Office Action issued in Chinese Application No. 200980154599.1, mailing date Mar. 23, 2012, (6 pages).

* cited by examiner

STEREO ENCODING METHOD AND APPARATUS

CROSS-REFERENCE TO RELATED APPLICATIONS

This application is a continuation of International Application No. PCT/CN2009/070428, filed on Feb. 13, 2009, which are hereby incorporated by reference in its entireties.

FIELD OF THE INVENTION

The present invention relates to the field of stereo technologies, and in particular, to a stereo encoding method and apparatus.

BACKGROUND OF THE INVENTION

A stereo technology is for the purpose of transmitting or reconstructing a certain specified sound field, so as to reproduce acoustic and spatial characteristics of an original sound field for listeners. In recent years, with the development of a computer technology and digital signal processing technology, and due to the needs of development of high-definition television sound systems and home audiovisual systems, the stereo technology has undergone significant development, and meanwhile, higher requirements are imposed on the stereo technology, especially stereo encoding and decoding technologies.

The conventional stereo encoding methods may be categorized into two types: one type is early waveform-based stereo encoding method, and the other type is currently commonly-used parametric stereo encoding method. In the parametric stereo encoding method, generally, left and right channel signals are down-mixed rather than being directly encoded, the down-mixed signals are encoded, and some extra sideband information is also encoded. At a decoding end, a stereo signal is recovered by using the down-mixed signals and the sideband information.

The quality of the stereo signal depends, to a large extent, on the quality of the down-mixed signals. The more synchronous are the left and right channel signals, the less information is lost in the down-mixing process. Generally, distances from a sound emitting object to two microphones recording sounds the left and right channels may change or be different, which inevitably leads to a delay between the left and right channel signals. The left and right channel signals cannot be completely synchronized. If the delay can be adjusted in the down-mixing process, that is, the left and right channel signals are synchronized, the quality of the synthesized stereo signal may be improved to a great extent.

FIG. 1 is a schematic flow chart of a stereo encoding method in the prior art. Referring to FIG. 1, firstly, a residual signal is obtained by performing down-sampling 4, Linear Predictive Coding (LPC) analysis, and LPC filtering on the left and right channel signals. Then, delays of the left and right channel signals are respectively extracted, and if the delays of two continuous frames of the left and right channel signals are different, a delay adjustment is performed before the down-mixing process.

In the process of implementing the present invention, the inventor finds that:

Because the left and right channel signals need to be spliced and added in the delay adjustment process, distortion is introduced, and the stereo signals with different characteristics have different distortion effects on discontinuity of interframe data during the splicing and adding process.

According to the prior art, as the characteristics of the stereo signals are not differentiated during a delay adjustment, and the delay adjustment is performed immediately as long as delays of two continuous frames of the left and right channel signals are different, serious distortion may be caused.

SUMMARY OF THE INVENTION

The embodiments of the present invention provide a stereo encoding method and apparatus, so as to reduce distortion caused by a delay adjustment.

Specifically, an embodiment of the present invention provides a stereo encoding method. The method includes: extracting a current interchannel delay of a stereo signal and a previous delay adjacent to the current interchannel delay; performing adjustment frame judgment according to characteristics of the current stereo signal when the current delay and the previous delay are different; and performing a delay adjustment on the stereo signal by using the current interchannel delay if it is judged that a frame where the current delay occurs is an adjustment frame.

Another embodiment of the present invention provides a stereo encoding apparatus. The includes: a delay extracting unit, configured to obtain a current interchannel delay of a stereo signal and a previous delay adjacent to the current interchannel delay; a judging unit, configured to perform adjustment frame judgment according to characteristics of the current stereo signal when the current delay and the previous delay that are obtained by the delay extracting unit are different; and a delay adjusting unit, configured to perform a delay adjustment on the stereo signal by using the current interchannel delay when the judging unit judges that a frame where the current delay occurs is an adjustment frame.

It can be known from the description of the foregoing technical solutions that, the current interchannel delay of the stereo signal and the previous delay adjacent to the current interchannel delay are extracted, the adjustment frame judgment is performed according to the characteristics of the current stereo signal when the current delay and the previous delay are different, and the delay adjustment is performed on the stereo signal by using the current interchannel delay only when it is judged that the frame where the current delay occurs is the adjustment frame. In this way, the delay may be adjusted only at a suitable time for an adjustment, thereby the distortion caused by a delay adjustment may be reduced.

BRIEF DESCRIPTION OF THE DRAWINGS

To illustrate the technical solutions in the embodiments of the present invention or in the prior art more clearly, the accompanying drawings for describing the embodiments or the prior art are described briefly in the following. Apparently, the accompanying drawings in the following description are only some embodiments of the present invention, and persons of ordinary skill in the art may derive other drawings from the accompanying drawings without creative efforts.

DETAILED DESCRIPTION OF THE EMBODIMENTS

To make the objectives, technical solutions, and advantages of the present invention clearer, the technical solutions of the present invention are described in further detail in the following with reference to embodiments and the accompanying drawings. It is obvious that the embodiments to be described are only a part rather than all of the embodiments of the present invention. All other embodiments obtained by persons skilled in the art based on the embodiments of the present invention without creative efforts also fall within the protection scope of the present invention.

Figure 1:
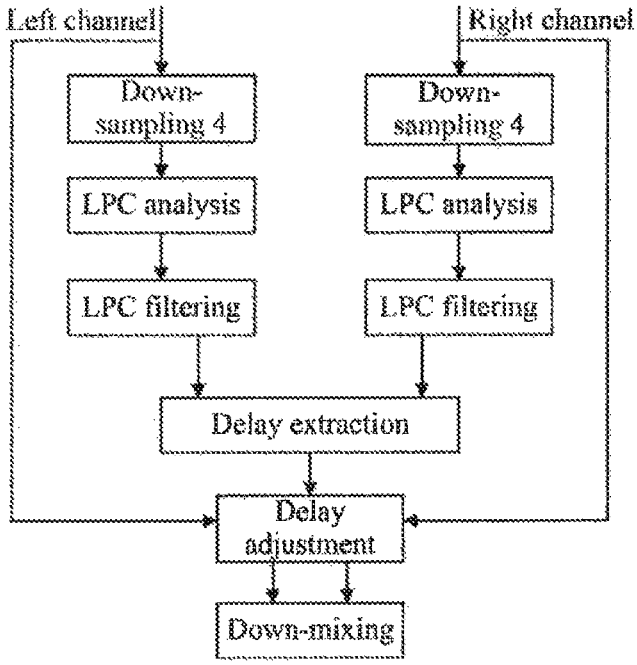
FIG. 1 (PRIOR ART)
FIG. 1 is a schematic flow chart of a stereo encoding method in the prior art.
Figure 2:
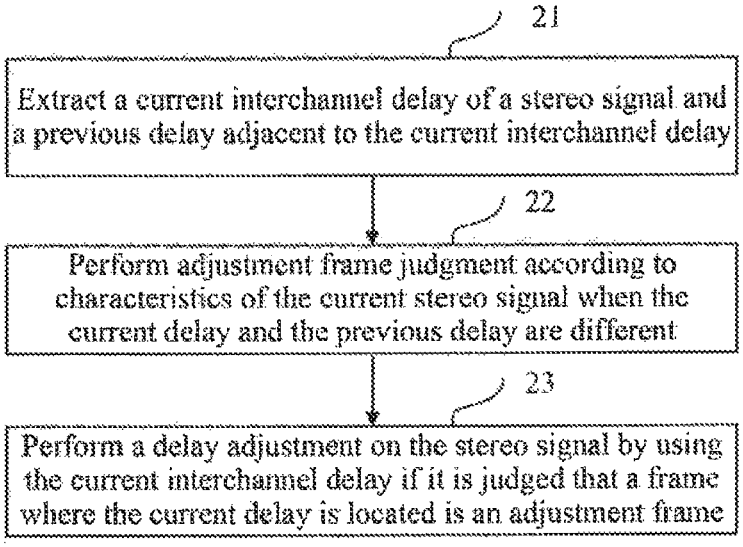
FIG. 2 is a flow chart of a stereo encoding method according to an embodiment of the present invention.

Referring to FIG. 2, a stereo encoding method provided in an embodiment of the present invention includes the following steps:

Step 21: Extract a current interchannel delay of a stereo signal and a previous delay adjacent to the current interchannel delay.

Step 22: Perform adjustment frame judgment according to characteristics of the current stereo signal when the current delay and the previous delay are different.

Step 23: Perform a delay adjustment on the stereo signal by using the current interchannel delay if it is judged that a frame where the current delay occurs is an adjustment frame.

According to the stereo encoding method of the embodiment of the present invention, the current interchannel delay of the stereo signal and the previous delay adjacent to the current interchannel delay are extracted, the adjustment frame judgment is performed according to the characteristics of the current stereo signal when the current delay and the previous delay are different, and the delay adjustment is performed on the stereo signal by using the current interchannel delay only when it is judged that the frame where the current delay occurs is the adjustment frame, so that the delay is adjusted only at a suitable time for an adjustment. Therefore, distortion caused by a delay adjustment may be reduced.

Figure 3:
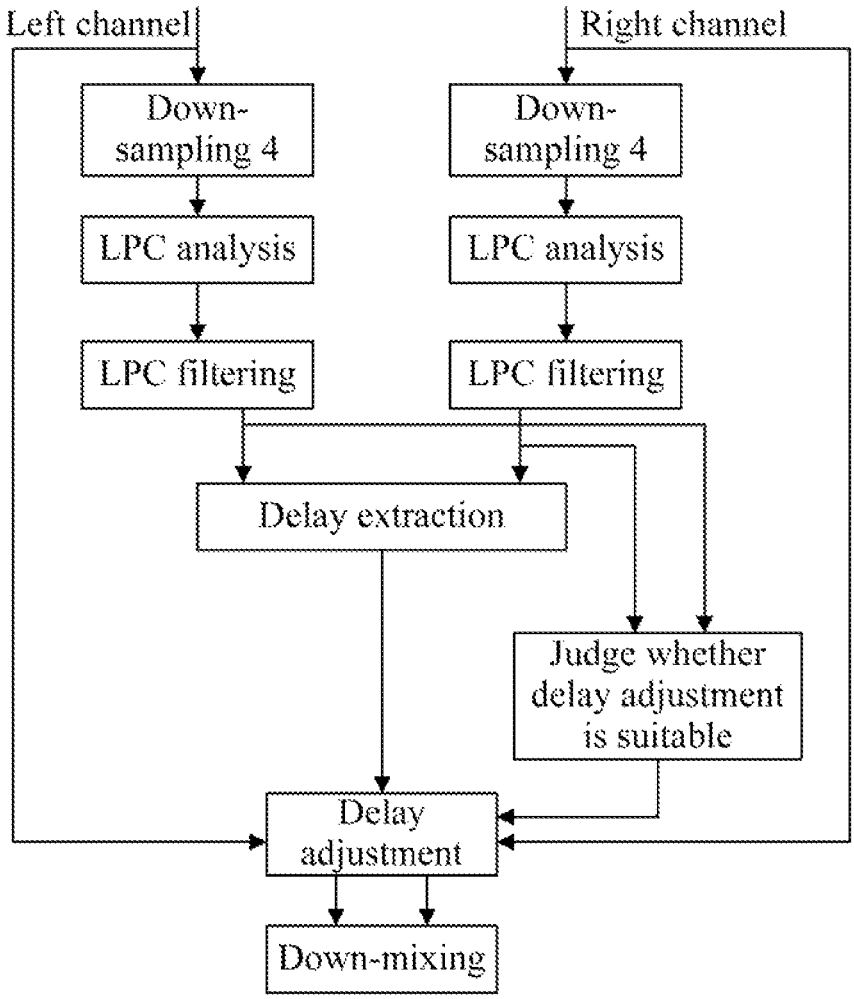
FIG. 3 is a schematic flow chart of a stereo encoding method according to an embodiment of the present invention.

FIG. 3 is a schematic flow chart of a stereo encoding method provided by an embodiment of the present invention. Compared with the prior art, firstly, a residual signal is obtained by performing down-sampling 4, LPC analysis, and LPC filtering on left and right channel signals, and then delays of the left and right channel signals are respectively extracted. It is judged whether a delay adjustment is suitable before down-mixing when the delays of two continuous frames of the left and right channel signals are different. When the delays of the two continuous frames are different, at a place where a delay adjustment needs to be performed on the stereo signal, adjustment frame judgment is performed according to characteristics of the current stereo signal; and if it is judged that a frame where the current delay occurs is an adjustment frame, a delay adjustment is performed on the stereo signal by using a current interchannel delay.

According to the embodiments of the present invention, the following judging methods for performing the adjustment frame judgment according to the characteristics of the stereo signal are provided.

One method is to perform the judgment according to a type of the stereo signal. The method specifically includes: determining that the frame where the current delay occurs is the adjustment frame when the stereo signal is an unvoiced frame or a silent frame; and determining that the frame where the current delay occurs is a non-adjustment frame when the stereo signal is a voiced frame.

Figure 4:
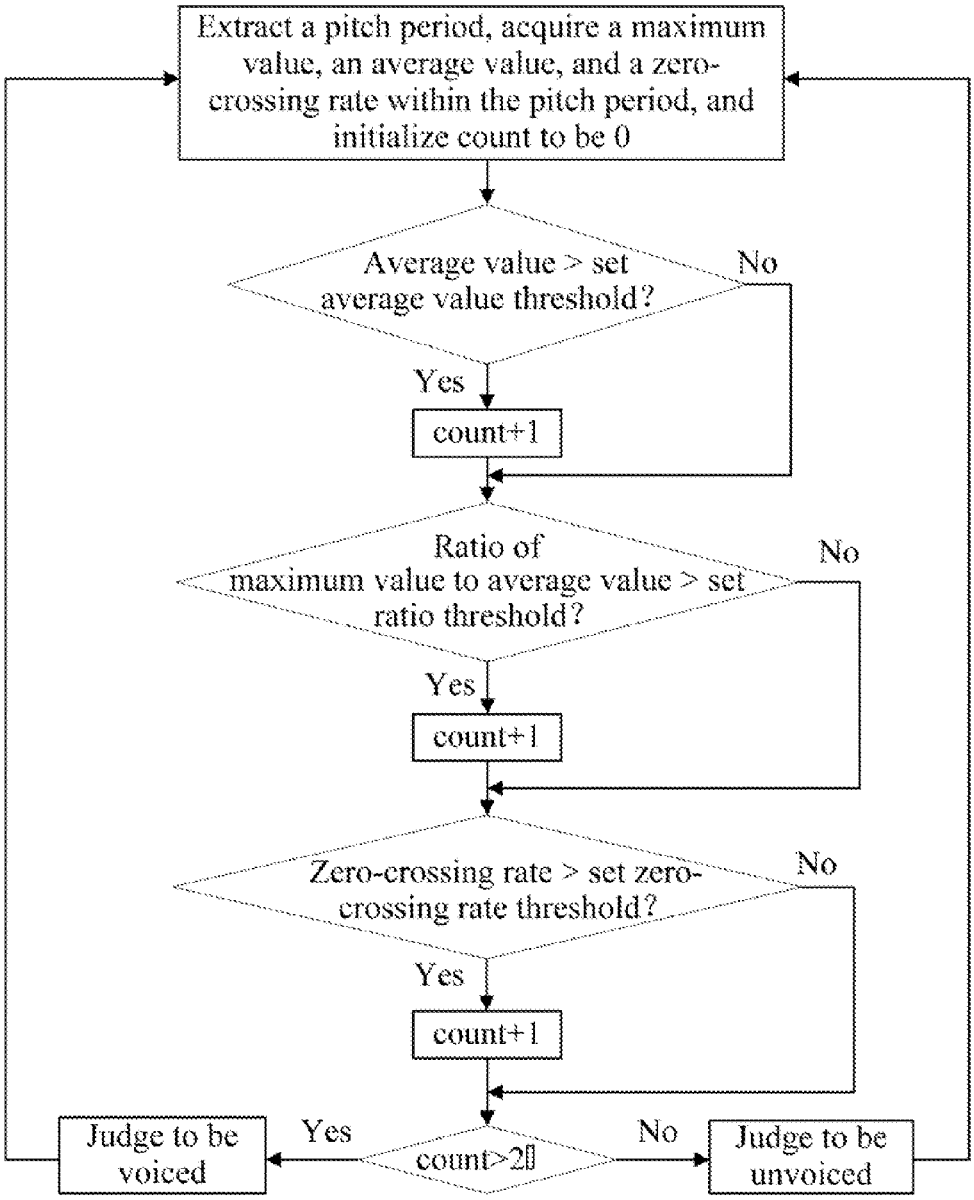
FIG. 4 is a flow chart of determining voiced and unvoiced sounds in a channel according to an embodiment of the present invention.

FIG. 4 is a flow chart of determining voiced and unvoiced sounds in a channel. Referring to FIG. 4, in this flow, the type of a stereo signal is judged according to an average value, a maximum value, and a zero-crossing rate within a pitch period of the stereo signal. Firstly, the pitch period of the signal is extracted, and value of a counter Count is initialized to be 0; then the maximum value and the average value within the pitch period are extracted, and the average value is compared with a pre-set threshold of an average value, and if the average value is greater than the pre-set threshold of an average value, the value of the counter is increased by 1 (count+1); otherwise, the count remains unchanged. Next, a ratio of the maximum value to the average value within the pitch period is compared with a set ratio threshold, and if the ratio is greater than the ratio threshold, the value of the counter is increased by 1 (count+1); otherwise, the count remains unchanged. Afterwards, the zero-crossing rate is acquired and compared with a set zero-crossing rate threshold, and if the zero-crossing rate is greater than the zero-crossing rate threshold, the value of the counter is increased by 1 (count+1); otherwise, the count remains unchanged. Finally, the count is compared with 2, and if the count is greater than 2, it is judged that the signal is a voiced frame; if count is not greater than 2, it is judged that the signal is an unvoiced frame.

It should be noted that judgment method of the silent type may be processed similar to the judgment method of the unvoiced sound. According to the foregoing judgment process, during calculation and programming, 1 may be output for a voiced frame, and 0 may be output for an unvoiced frame or a silent frame.

The type of the entire stereo signal is determined by the types of the left and right channel signals. And only when the types of the left and right channel signals are voiced signals at the same time, it is judged that the stereo signal is a voiced signal.

Another method is to perform the judgment according to energy of a stereo signal. The method specifically includes: determining that the frame where the current delay occurs is an adjustment frame when frame energy of the stereo signal is less than a set threshold value; and determining that the frame where the current delay occurs is a non-adjustment frame when the frame energy of the stereo signal is greater than or equal to the set threshold value.

Still another method is to perform the judgment according to a combination of the type and energy of the stereo signal. The method specifically includes: determining that a frame where a current delay occurs is an adjustment frame if the stereo signal is an unvoiced frame or a silent frame and frame energy of the stereo signal is less than a certain set threshold value; determining that the frame where the current delay occurs is a non-adjustment frame if the stereo signal is not an unvoiced frame or a silent frame or frame energy of the stereo signal is not less than a certain set threshold value; or, determining that the frame where the current delay occurs is the adjustment frame; determining that the frame where the current delay occurs is a non-adjustment frame if the stereo signal is not an unvoiced frame or a silent frame or frame energy of the stereo signal is not less than a certain set threshold value.

Accordingly, the foregoing judging methods are only used as exemplary embodiments of the present invention, and are not particularly limited in the present invention. For example, as for voice signals having loud background noise or music signals having weak periodicity, other methods may be used to perform the adjustment frame judgment.

Figure 5:
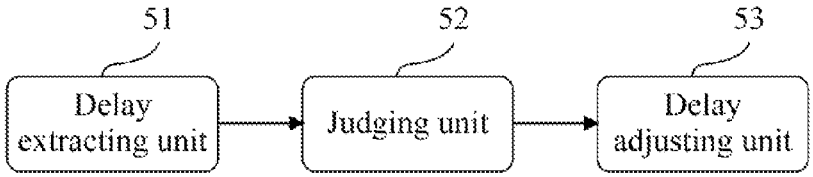
FIG. 5 is a schematic structural diagram of a stereo encoding apparatus according to an embodiment of the present invention.

Referring to FIG. 5, an embodiment of the present invention further provides a stereo encoding apparatus, which includes a delay extracting unit 51, a judging unit 52, and a delay adjusting unit 53.

The delay extracting unit 51 is configured to obtain a current interchannel delay of a stereo signal and a previous delay adjacent to the current interchannel delay.

The judging unit 52 is configured to perform adjustment frame judgment according to characteristics of the current stereo signal when the current delay and the previous delay that are obtained by the obtaining delay unit are different.

The delay adjusting unit 53 is configured to perform a delay adjustment on the stereo signal by using the current interchannel delay when the judging unit judges that a frame where the current delay occurs is an adjustment frame.

Preferably, the judging unit 52 includes any one of the following modules: a type judging module, an energy judging module, and a type and energy judging module.

The type judging module is configured to perform the adjustment frame judgment according to a type of the stereo signal.

The energy judging module is configured to perform the adjustment frame judgment according to energy of the stereo signal.

The type and energy judging module is configured to perform the adjustment frame judgment according to a combination of the type and energy of the stereo signal.

Specifically, the type judging module is configured to judge that the frame where the current delay occurs is the adjustment frame when the stereo signal is an unvoiced frame or a silent frame, and judge that the frame where the current delay occurs is a non-adjustment frame when the stereo signal is a voiced frame.

The energy judging module is configured to judge that the frame where the current delay occurs is the adjustment frame when frame energy of the stereo signal is less than a certain set threshold value, and judge that the frame where the current delay occurs is a non-adjustment frame when the frame energy of the stereo signal is greater than or equal to the certain set threshold value.

The type and energy judging module is configured to judge that the frame where the current delay occurs is the adjustment frame when the stereo signal is an unvoiced frame or a silent frame and frame energy of the stereo signal is less than a certain set threshold value; otherwise, judge that the frame where the current delay occurs is a non-adjustment frame; or, the type and energy judging module is configured to judge that the frame where the current delay occurs is the adjustment frame when the stereo signal is an unvoiced frame or a silent frame or frame energy of the stereo signal is less than a certain set threshold value; otherwise, judge that the frame where the current delay occurs is a non-adjustment frame.

Accordingly, the judging unit is not limited to implemented by the foregoing judging modules, the foregoing modules are described as exemplary embodiments of the present invention, and other determining modules may be used to perform the adjustment frame judgment, which is not particularly limited in the present invention.

According to the stereo encoding apparatus provided by the embodiment of the present invention, the delay extracting unit 51 extracts the current interchannel delay of the stereo signal and the previous delay adjacent to the current interchannel delay, the judging unit 52 performs the adjustment frame judgment according to the characteristics of the current stereo signal when the current delay and the previous delay are different, and the delay adjusting unit 53 performs the delay adjustment on the stereo signal by using the current interchannel delay only when the frame where the current delay occurs is the adjustment frame, so that the delay is adjusted only at a suitable time for an adjustment, thereby distortion caused by a delay adjustment can be reduced.

It should be noted that, persons of ordinary skill in the art may understand that all or a part of the processes of the methods according to the embodiments may be implemented by a computer program instructing relevant hardware. The program may be stored in a computer readable storage medium. When the program is executed, the processes of the methods according to the embodiments are performed. The storage medium may be a magnetic disk, an optical disk, a Read-Only Memory (ROM), or a Random Access Memory (RAM).

All functional units according to the embodiments of the present invention may be integrated in one processing module, or may exist as separate physical units; or two or more than two units may also be integrated in one module. The integrated module may be implemented through hardware, or may also be implemented in a form of a software functional module. When the integrated module is implemented in the form of the software functional module and sold or used as a separate product, the integrated module may be stored in a computer readable storage medium. The storage medium may be a ROM, a magnetic disk, an optical disk, or the like.

The foregoing specific embodiments are not intended to limit the present invention, and it should be understood by persons of ordinary skill in the art that, any modification, equivalent replacement, or improvement made without departing from the principle of the present invention should fall within the protection scope of the present invention.

What is claimed is:

1. A stereo encoding method comprising:

extracting a current interchannel delay of a stereo signal and a previous interchannel delay of the stereo signal that is adjacent to the current interchannel delay;

performing adjustment frame judgment according to characteristics of the stereo signal when the current interchannel delay and the previous interchannel delay are different, wherein the adjustment frame judgment is performed according to energy of the stereo signal, and wherein performing the adjustment frame judgment includes determining that a frame where the current interchannel delay occurs is an adjustment frame when frame energy of the stereo signal is less than a certain set threshold value and determining that the frame where the current interchannel delay occurs is a non-adjustment frame when the frame energy of the stereo signal is greater than or equal to the certain threshold value; and performing an interchannel delay adjustment on the stereo signal by using the current interchannel delay if it is determined that the frame where the current interchannel delay occurs is the adjustment frame.

2. The method according to claim 1, wherein performing the adjustment frame judgment according to the characteristics of the stereo signal further comprises performing the adjustment frame judgment according to a type of the stereo signal.

3. The method according to claim 2, wherein performing the adjustment frame judgment according to the type of the stereo signal comprises:

determining that the frame where the current interchannel delay occurs is the adjustment frame when the stereo signal is an unvoiced frame or a silent frame; and determining that the frame where the current interchannel delay occurs is the non-adjustment frame when the stereo signal is a voiced frame.

4. The method according to claim 1, wherein performing the adjustment frame judgment according to the characteristics of the stereo signal further comprises performing the adjustment frame judgment according to a combination of a type and the energy of the stereo signal.

5. The method according to claim 4, wherein performing the adjustment frame judgment according to a combination of the type and the energy of the stereo signal comprises:

determining that the frame where the current interchannel delay occurs is the adjustment frame if the stereo signal is an unvoiced frame, a silent frame, or the frame energy of the stereo signal is less than the certain set threshold value; and determining that the frame where the current interchannel delay occurs is the non-adjustment frame if the stereo signal is a voiced frame or the frame energy of the stereo signal is greater than or equal to the certain set threshold value.

6. A stereo encoding method comprising:

extracting a current interchannel delay of a stereo signal and a previous interchannel delay of the stereo signal that is adjacent to the current interchannel delay;

performing adjustment frame judgment according to characteristics of the stereo signal when the current interchannel delay and the previous interchannel delay are different, wherein the adjustment frame judgment is performed according to a combination of a type and an energy of the stereo signal, wherein performing the adjustment frame judgment according to the combination of the type and the energy of the stereo signal comprises determining that a frame where the current interchannel delay occurs is an adjustment frame if the stereo signal is an unvoiced frame and frame energy of the stereo signal is less than a certain set threshold value, or if the stereo signal is a silent frame and frame energy of the stereo signal is less than a certain set threshold value, and wherein performing the adjustment frame judgment according to the combination of the type and the energy of the stereo signal comprises determining that the frame where the current interchannel delay occurs is a non-adjustment frame if the stereo signal is a voiced frame or the frame energy of the stereo signal is greater than or equal to the certain set threshold value; and performing an interchannel a delay adjustment on the stereo signal by using the current interchannel delay if it is determined that the frame where the current interchannel delay occurs is the adjustment frame.

7. A stereo encoding apparatus comprising:

a delay extracting unit configured to obtain a current interchannel delay of a stereo signal and a previous interchannel delay that is adjacent to the current interchannel delay;

a judging unit configured to perform adjustment frame judgment according to characteristics of the stereo signal when the current interchannel delay and the previous interchannel delay that are obtained by the delay extracting unit are different, wherein the judging unit comprises an energy judging module configured to perform the adjustment frame judgment according to energy of the stereo signal, wherein the energy judging module is specifically configured to determine that a frame where the current interchannel delay occurs is an adjustment frame when frame energy of the stereo signal is less than a certain set threshold value and determine that the frame where the current interchannel delay occurs is a non-adjustment frame when the frame energy of the stereo signal is greater than or equal to the certain set threshold value; and a delay adjusting unit configured to perform an interchannel delay adjustment on the stereo signal by using the current interchannel delay when the judging unit determines that the frame where the current interchannel delay occurs is the adjustment frame.

8. The apparatus according to claim 7, wherein the judging unit further comprises a type judging module configured to perform the adjustment frame judgment according to a type of the stereo signal.

9. The apparatus according to claim 8, wherein the energy judging module and the type judging module of the judging unit are configured to perform the adjustment frame judgment according to a combination of the type and the energy of the stereo signal.

10. The apparatus according to claim 9, wherein the energy judging module and the type judging module are configured to determine that the frame where the current interchannel delay occurs is the adjustment frame if the stereo signal is an unvoiced frame, a silent frame, or the frame energy of the stereo signal is less than the certain set threshold value and determine that the frame where the current interchannel delay occurs is the non-adjustment frame if the stereo signal is a voiced frame or the frame energy of the stereo signal is greater than or equal to the certain set threshold value.

11. The apparatus according to claim 8, wherein the type judging module is configured to determine that the frame where the current interchannel delay occurs is the adjustment frame when the stereo signal is an unvoiced frame or a silent frame and determine that the frame where the current interchannel delay occurs is a non-adjustment frame when the stereo signal is a voiced frame.

12. A stereo encoding apparatus comprising:

a delay extracting unit configured to obtain a current interchannel delay of a stereo signal and a previous interchannel delay that is adjacent to the current interchannel delay;

a judging unit configured to perform adjustment frame adjustment according to characteristics of the stereo signal when the current interchannel delay and the previous interchannel delay that are obtained by the delay extracting unit are different, wherein the judging unit comprises a type and energy judging module configured to perform the adjustment frame adjustment according to a combination of a type and an energy of the stereo signal, wherein the type and energy judging module is configured to determine that a frame where the current interchannel delay occurs is an adjustment frame if the stereo signal is an unvoiced frame and frame energy of the stereo signal is less than a certain set threshold value, or if the stereo signal is a silent frame and the frame energy of the stereo signal is less than a certain set threshold value, and wherein the type and energy judging module is further configured to determine that the frame where the current interchannel delay occurs is a non-adjustment frame if the stereo signal is a voiced frame or the frame energy of the stereo signal is greater than or equal to the certain set threshold value; and a delay adjustment unit configured to perform an interchannel delay adjustment on the stereo signal by using the current interchannel delay when the judging unit determines that the frame where the current interchannel delay occurs is the adjustment frame.

13. A non-transitory computer readable storage medium, comprising computer program codes that cause a computer processor to execute the following steps when executed by the computer processor:

extracting a current interchannel delay of a stereo signal and a previous interchannel day that is adjacent to the current interchannel delay;

performing adjustment frame judgment according to characteristics of the current stereo signal when the current interchannel delay and the previous interchannel delay are different, wherein the adjustment frame judgment is performed according to a combination of a type and an energy of the stereo signal, wherein performing the adjustment frame judgment according to the combination of the type and the energy of the stereo signal comprises determining that a frame where the current interchannel delay occurs is an adjustment frame if the stereo signal is an unvoiced frame and frame energy of the stereo signal is less than a certain set threshold value, or if the stereo signal is a silent frame and frame energy of the stereo signal is less than a certain set threshold value, and wherein performing the adjustment frame adjusting according to the combination of the type and the energy of the stereo signal further comprises determining that the frame where the current interchannel delay occurs is a non-adjustment frame if the stereo signal is a voiced frame or the frame energy of the stereo signal is greater than or equal to the certain set threshold value; and performing an interchannel delay adjustment on the stereo signal by using the current interchannel delay if it is judged that the frame where the current delay occurs is the adjustment frame.

14. A non-transitory computer readable storage medium, comprising computer program codes that cause a computer processor to execute the following steps when executed by the computer processor:

extracting a current interchannel delay of a stereo signal and a previous interchannel delay of the stereo signal that is adjacent to the current interchannel delay;

performing adjustment frame judgment according to characteristics of the stereo signal when the current interchannel delay and the previous interchannel delay are different, wherein, the adjustment frame judgment is performed according to energy of the stereo signal, and wherein performing the adjustment frame judgment includes determining that a frame where the current interchannel delay occurs is an adjustment frame when frame energy of the stereo signal is less than a certain set threshold value and determining that the frame where the current interchannel delay occurs is a non-adjustment frame when the frame energy of the stereo signal is greater than or equal to the certain threshold value; and performing an interchannel delay adjustment on the stereo signal by using the current interchannel delay if it is determined that the frame where the current interchannel delay occurs is the adjustment frame.

* * * * *

UNITED STATES PATENT AND TRADEMARK OFFICE

CERTIFICATE OF CORRECTION

PATENT NO. : 8,489,406 B2
APPLICATION NO. : 13/208460
DATED : July 16, 2013
INVENTOR(S) : Wenhai Wu et al.

It is certified that error appears in the above-identified patent and that said Letters Patent is hereby corrected as shown below:

In the Claims:

Column 9, Line 1 - Column 10, Line 4 - Claim 13 should read as follows:

13. A non-transitory computer readable storage medium, comprising computer program codes that cause a computer processor to execute the following steps when executed by the computer processor:
extracting a current interchannel delay of a stereo signal and a previous interchannel delay that is adjacent to the current interchannel delay;
performing adjustment frame judgment according to characteristics of the current stereo signal when the current interchannel delay and the previous interchannel delay are different, wherein the adjustment frame judgment is performed according to a combination of a type and an energy of the stereo signal, wherein performing the adjustment frame judgment according to the combination of the type and the energy of the stereo signal comprises determining that a frame where the current interchannel delay occurs is an adjustment frame if the stereo signal is an unvoiced frame and frame energy of the stereo signal is less than a certain set threshold value, or if the stereo signal is a silent frame and frame energy of the stereo signal is less than a certain set threshold value, and wherein performing the adjustment frame adjustment according to the combination of the type and the energy of the stereo signal further comprises determining that the frame where the current interchannel delay occurs is a non-adjustment frame if the stereo signal is a voiced frame or the frame energy of the stereo signal is greater than or equal to the certain set threshold value; and
performing an interchannel delay adjustment on the stereo signal by using the current interchannel delay if it is judged that the frame where the current delay occurs is the adjustment frame.

Signed and Sealed this
Third Day of September, 2013

Teresa Stanek Rea

Teresa Stanek Rea
*Acting Director of the United States Patent and Trademark Office*